United States Patent [19]

Smith et al.

[11] 4,145,000

[45] Mar. 20, 1979

[54] SNOW-MAKING NOZZLE ASSEMBLY

[76] Inventors: Fergus S. Smith, P.O. Box 57, South Londonderry, Vt. 05155; David I. Arch, P.O. Box 487, Pocassett, Mass. 02559

[21] Appl. No.: 759,300

[22] Filed: Jan. 14, 1977

[51] Int. Cl.[2] ..... F25C 3/04

[52] U.S. Cl. ..... 239/14; 239/426; 239/429; 239/567

[58] Field of Search ..... 239/2 S, 14, 422, 424.5, 239/429, 426, 549, 567; 62/74

[56] References Cited

U.S. PATENT DOCUMENTS

| | | | |
|---|---|---|---|
| 733,579 | 7/1903 | Fitton | 239/426 X |
| 1,285,952 | 11/1918 | DeRos | 239/422 |
| 1,304,092 | 5/1919 | Poss | 239/429 X |
| 2,425,709 | 8/1947 | Bucknam et al. | 239/549 X |
| 2,425,710 | 8/1947 | Bucknam et al. | 239/549 X |
| 2,676,471 | 4/1954 | Pierce, Jr. | 239/2 S |
| 3,908,903 | 9/1975 | Burns, Jr. | 239/2 S |

*Primary Examiner*—Robert B. Reeves
*Assistant Examiner*—Michael J. Forman
*Attorney, Agent, or Firm*—Jones, Tullar & Cooper

[57] ABSTRACT

A snow-making nozzle assembly which is very effective in producing uniform, small, highly atomized droplets of liquid that freeze to form snow is disclosed. The nozzle assembly in accordance with the present invention is comprised generally of opposed pairs of water outlets spaced at the periphery of a generally fan-shaped convergent-divergent compressed air nozzle. The water streams emitted from the water outputs impinge on each other and atomize substantially without contacting the walls of the nozzle. These liquid particles are entrained in the compressed air stream for further atomization and for distribution into the ambient air. The use of the nozzle in accordance with the present invention results in greatly improved snow-making capabilities when compared with prior art devices.

10 Claims, 3 Drawing Figures

FIG. 2
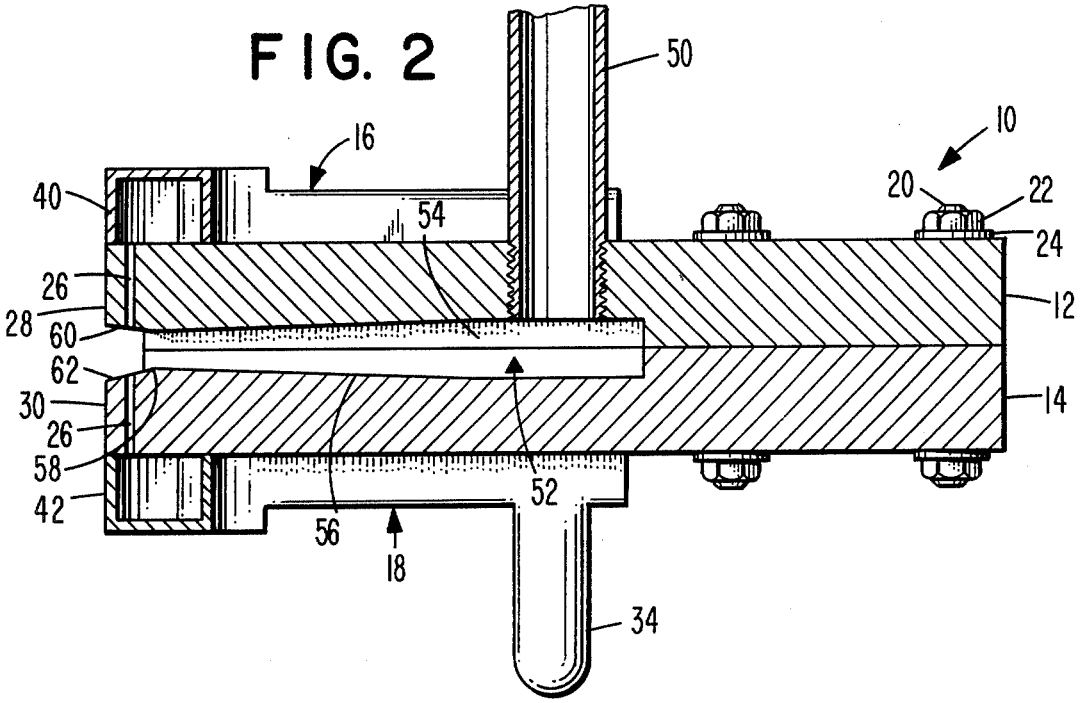
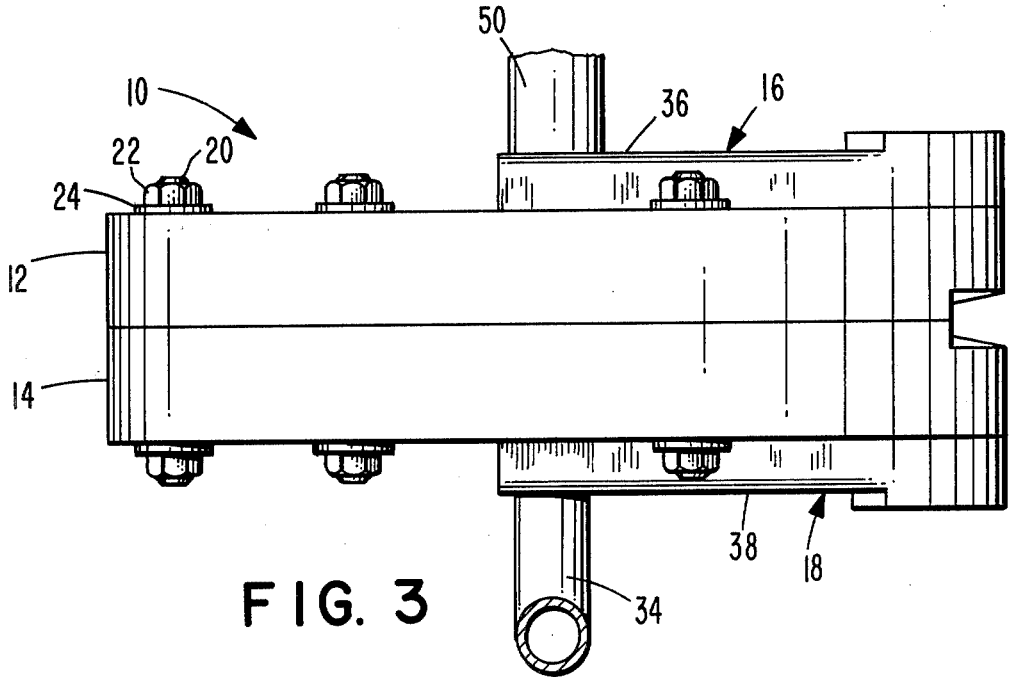
FIG. 3

SNOW-MAKING NOZZLE ASSEMBLY

FIELD OF THE INVENTION

The present invention is directed generally to an atomizing nozzle. More specifically, the present invention is directed to an atomizing nozzle for use in making artificial or man-made snow. Most particularly, the present invention is directed to a snow-making nozzle assembly in which the liquid is atomized and distributed in fine, uniformly sized particles. The snow-making nozzle in accordance with the present invention is comprised generally of a pair of disc-shaped body portions having spaced, opposed liquid outlet ports adjacent a portion of the periphery of the bodies. A converging-diverging nozzle is formed within the body plates with the liquid outlet ports being positioned exteriorly of the throat of the nozzle. Liquid streams are discharged under pressure from the liquid outlets to impinge on each other and atomize out of contact with the nozzle walls. These atomized particles are entrained in the compressed air flowing through the nozzle, are further atomized, and are carried out into the ambient air in a spray of small, uniformly sized particles which freeze to form snow.

DESCRIPTION OF THE PRIOR ART

Atomizing nozzles in general have been well known for a substantial time and have been utilized in a number of areas. Further, atomizing nozzle assemblies of a type generally similar to the present invention are known and have been utilized in oil burner assemblies and the like. Exemplary of such nozzle structures are the following U.S. patents:

U.S. Pat. No. 930,193 — Kittle et al.
U.S. Pat. No. 1,342,226 — Placette
U.S. Pat. No. 1,493,653 — Thomas
U.S. Pat. No. 1,525,587 — Moore In the patent to Kittle et al., U.S. Pat. No. 930,193 there is shown a hydrocarbon burner in which mixtures of hydrocarbons and steam are fed into chambers and are then forced out of each chamber through opposed openings to contact each other. The sprays are then directed away from the nozzle by the shape of the nozzle body.

The Placette U.S. Pat. No. 1,342,226, Thomas U.S. Pat. No. 1,493,653, and Moore U.S. Pat. No. 1,525,587, patents all show oil burner spray heads wherein oil is fed into one chamber and a pressurized fluid such as steam is fed into a second chamber. In all of these, the oil and fluid are brought into contact within the nozzle and are forced out for combustion. The Moore patent is of interest to the present invention since the fuel oil passes out through an array of holes placed about the periphery of one of the discs of the nozzle body. The second disc of the body includes a generally fan-shaped recess for the compressed fluid such as steam with the fan terminating adjacent the array of fuel holes.

While nozzles of this general structure have been utilized in oil burner construction and the like, they would not be satisfactory for use in the production of artificial or man-made snow. For example, in the Kittle patent, the oil and steam mixtures enter tangentially into circular mixing chambers where they are swirled about and finally leave the chambers to contact each other. While this may be acceptable for an oil burner, it is not suitable for use in snowmaking since there would be insufficient atomization to provide the uniform, small droplets required for snowmaking. Likewise, in the Moore patent the streams of fuel are caused to contact the opposite wall of the discs thereby producing droplets of widely varying sizes and further requiring substantial energy to separate the droplets from the wall in order to project an atomized spray instead of a sheet of liquid. As will be discussed in more detail hereinafter, the quality and quantity of snow which can be made by a snow-making gun is dependent on the size and uniformity of the droplets of water formed by the atomizing nozzle and hence the several atomizing nozzle assemblies discussed above would not be suitable for use in snow production.

The problems of producing good quality man-made snow in all possible operating conditions have by no means been solved as can be seen by referring to the large number of proposed solutions as set forth in the following patent which are all directed to methods and apparatus for making snow:

U.S. Pat. No. 2,676,471 — Pierce, Jr.
U.S. Pat. No. 2,968,164 — Hanson
U.S. Pat. No. 3,146,951 — Brown
U.S. Pat. No. 3,301,485 — Tropeano et al.
U.S. Pat. No. 3,372,872 — Le Bus III et al.
U.S. Pat. No. 3,434,661 — Boyle et al.
U.S. Pat. No. 3,464,625 — Carlsson
U.S. Pat. No. 3,494,559 — Skinner
U.S. Pat. No. 3,567,116 — Lindlof
U.S. Pat. No. 3,567,117 — Eustis
U.S. Pat. No. 3,596,476 — Jakob et al.
U.S. Pat. No. 3,610,527 — Ericson et al.
U.S. Pat. No. 3,703,991 — Eustis et al.
U.S. Pat. No. 3,706,414 — Dupre
U.S. Pat. No. 3,716,190 — Lindlof
U.S. Pat. No. 3,733,029 — Eustis et al.
U.S. Pat. No. 3,774,842 — Howell
U.S. Pat. No. 3,760,598 — Jakob et al.
U.S. Pat. No. 3,762,176 — Goggins, Jr.
U.S. Pat. No. 3,814,319 — Loomis
U.S. Pat. No. 3,822,825 — Dupre
U.S. Pat. No. 3,838,815 — Rice
U.S. Pat. No. 3,908,903 — Burns, Jr.

The above patents are not intended to be a comprehensive list of all patents directed to snow-making methods and apparatus but rather are exemplary of the art. While these patents present a diverse collection of art they all share one or more common features. They are all directed to the provision of systems and apparatus for forming a plurality of water particles which are forced into the ambient atmosphere to freeze and fall to the ground as snow for use in conjunction with or as a substitute for natural snow on ski slopes, trails, and the like. Some utilize internal mixing nozzles, others use external nozzles, some seed the water with crystals to promote nucleation. In some, the liquid is sprayed into a stream of air from large fans; in others, compressed air is utilized to carry the water into the air and atomize it. The conclusion that none of these known devices is completely satisfactory is evidenced by the continuing development in this area.

Common problems with existing snow-making equipment are an inability to produce large quantities of snow at low cost because of large air compressor requirements; the inability of the apparatus to function well at temperatures only slightly below freezing; the problem of non-uniformity of snow produced by any given piece of equipment; i.e. production of wet, heavy snow adjacent the gun and minute particles which do not stay in place away from the gun; the problem of complex agitators, whirlers, distributors and the like which freeze and malfunction; and the problem of heavy and cumbersome, as well as expensive, equipment which is difficult to position on the slopes and transport from place to place. Thus, the present atomizing nozzles in general are not suitable for use in snowmaking since they fail to efficiently produce the required uniform small particles. The numerous methods and apparatus directed specifically to snowmaking are also not entirely satisfactory for the reasons set forth above.

SUMMARY OF THE INVENTION

It is accordingly an object of the present invention to provide a snow-making nozzle which is of rugged and durable construction and which overcomes the various disadvantages of the prior art devices.

A further object of the present invention is to provide a snow-making nozzle which requires smaller volumes of compressed air than do prior devices, and operates at lower noise levels.

Still another object of the present invention is to provide a snow-making nozzle having a fan-shaped distribution pattern for optimum distribution of the snow made by the nozzle.

Yet another object of the present invention is to provide a snow-making nozzle which is suitable for producing snow at temperatures only slightly below freezing.

The snow-making nozzle in accordance with the present invention is comprised generally of a pair of disc shaped plates having opposed water ports about their peripheries. These ports are supplied with water from suitable headers. A generally flat, fan-shaped converging-diverging nozzle is formed within the plates with its throat interior of the opposed water ports. Compressed air at a pressure of 60–150 PSI and a flow rate of 50–300 CFM is fed to the nozzle while water at approximately the same pressure and at 5–100 GPM is fed to the ports. The water streams from the opposed ports impinge on each other midway between the ports so that the water is atomized without contacting the wall surfaces of the nozzle. The compressed air which has passed through the nozzle's venturi, contacts the atomized water and atomizes it further while carrying it out away from the nozzle and into the ambient air where it freezes and falls to the ground as snow.

As was discussed previously, it has been known in the field of oil burner atomizers to provide a flat, fan-shaped spray. However, the several oil burner nozzles discussed previously would not be suitable for use as a snow-making nozzle. In the Kittle et al. patent, the fuel and steam mixture would not be projected out from the nozzle a sufficient distance to function as a snow-making device. Further, and more importantly, the atomization of liquid produced by such a nozzle would not provide the uniform, small droplets required for the production of good snow. The particles formed by a nozzle such as shown in the Kittle patent are too large and of a non-uniform size and thus render a nozzle such as shown by Kittle unsuitable for use in snow-making.

The nozzle structure shown in the Moore patent would also be unsuitable for use as a snow-making nozzle since it also would not produce atomized particles in the range of 20–200 micron mass median diameter as is required for good snowmaking. In the Moore patent, the liquid is drawn out through the peripheral row of ports by passage of the high pressure steam thereover and is thus aspirated out of the oil chamber. Such a nozzle would not provide sufficient atomization to function properly as a snow-making device. If the Moore patent's oil supply were presurized to be driven out of the ports, the nozzle would still be unsatisfactory in snow-making since the liquid would be carried out of the nozzle assembly in a sheet or in several streams and would not be properly atomized.

As was also discussed above, there are a large number of patents directed to snow-making methods and equipment. However, a number of these prior patented methods and devices have either been expensive, not satisfactory over a wide range of temperature conditions, or have been unable to produce reasonable quantities of snow. The snow-making nozzle assembly of the present invention has a number of advantages over prior devices. It is rugged, durable and virtually maintenance free and has no moving parts. It produces a flat, fan-shaped pattern of snow in contrast to the cones produced by many prior devices. In contrast to many prior devices which need 600–1000 CFM of compressed air, the assembly of the present invention operates using only 50–300 CFM. The compressed air is used at a pressure of 60–150 PSI thus not requiring overly large or expensive compressors. Since the cost of the compressed air can amount to upwards of 90 percent of the cost of making snow, the ability of the snow-making nozzle of the present invention to operate with reduced air requirements is particularly important. While many snow-making systems will function at temperatures below 0° F., the present assembly is intended to function well at 20°–25° F. This feature is important since the need for man-made snow is apt to be the greatest during the early part of the season when the weather is still relatively warm.

The snow-making nozzle assembly of the present invention is particularly effective in providing the uniform, small droplets required for snowmaking. As the size of the droplet decreases, its ratio of surface area to weight increases. Thus, the smaller the particles, the greater their ability to transfer heat to the surrounding air and the greater the probability that the droplets will fall to the ground as snow instead of wet mist or slush. The present nozzle not only is effective in producing small droplets; i.e., in the range of 20–200 micron mass median diameter, but also produces a spray of droplets of uniform size. This is important in reducing the problems of puddling and production of too fine particles which plague other systems. Droplets which are too large will not freeze and fall in front of the gun to form puddles, while droplets which are too small freeze and are blown away before they hit the ground. Since the nozzle assembly of the present invention produces a spray of uniformly sized particles, this problem is substantially reduced.

The nozzle in accordance with the present invention incorporates the best features of both internal and external gas atomizing nozzles. There is an efficient energy transfer from the compressed gas to the liquid because of the confinement of the gas and liquid as in an internal mixing nozzle. Since the droplets of liquid are atomized out of contact with the walls of the nozzle there is finer atomization for the production of a uniform array of small droplets as would be apt to occur in an external atomizing nozzle. The nozzle is also quieter in operation than are the prior art devices since the mixing of the air and water takes place within the nozzle. A further advantage of the present invention is its ability to produce a flat, fan-shaped spray which is ideal for the heat transfer required to freeze the atomized particles and which also provides a suitable distribution pattern for putting the snow onto the slope in a uniform manner.

Thus it may be seen that the snow-making nozzle in accordance with the present invention combines the best feature of internal and external atomizing nozzles to provide a snow-making apparatus which is able to produce high quality snow over a wide range of temperatures and flow rates, while requiring much less energy in the form of compressed air than do prior devices. The flat, fan-shaped pattern of spray is ideal for effective heat transfer and for producing a uniform coating of snow on a slope.

BRIEF DESCRIPTION OF THE DRAWINGS

While the novel features of the present invention are set forth with particularity in the appended claims, a full and complete understanding of the present invention may be had be reference to the description of a preferred embodiment as set forth hereinafter and as may be seen in the accompanying drawings in which:

FIG. 2 is a schematic side elevation view, partly in section taken along line 2—2 in FIG. 1; and FIG. 3 is a schematic side elevation view, partly in section, taken along line 3—3 of FIG. 1.

DESCRIPTION OF A PREFERRED EMBODIMENT

Figure 1:
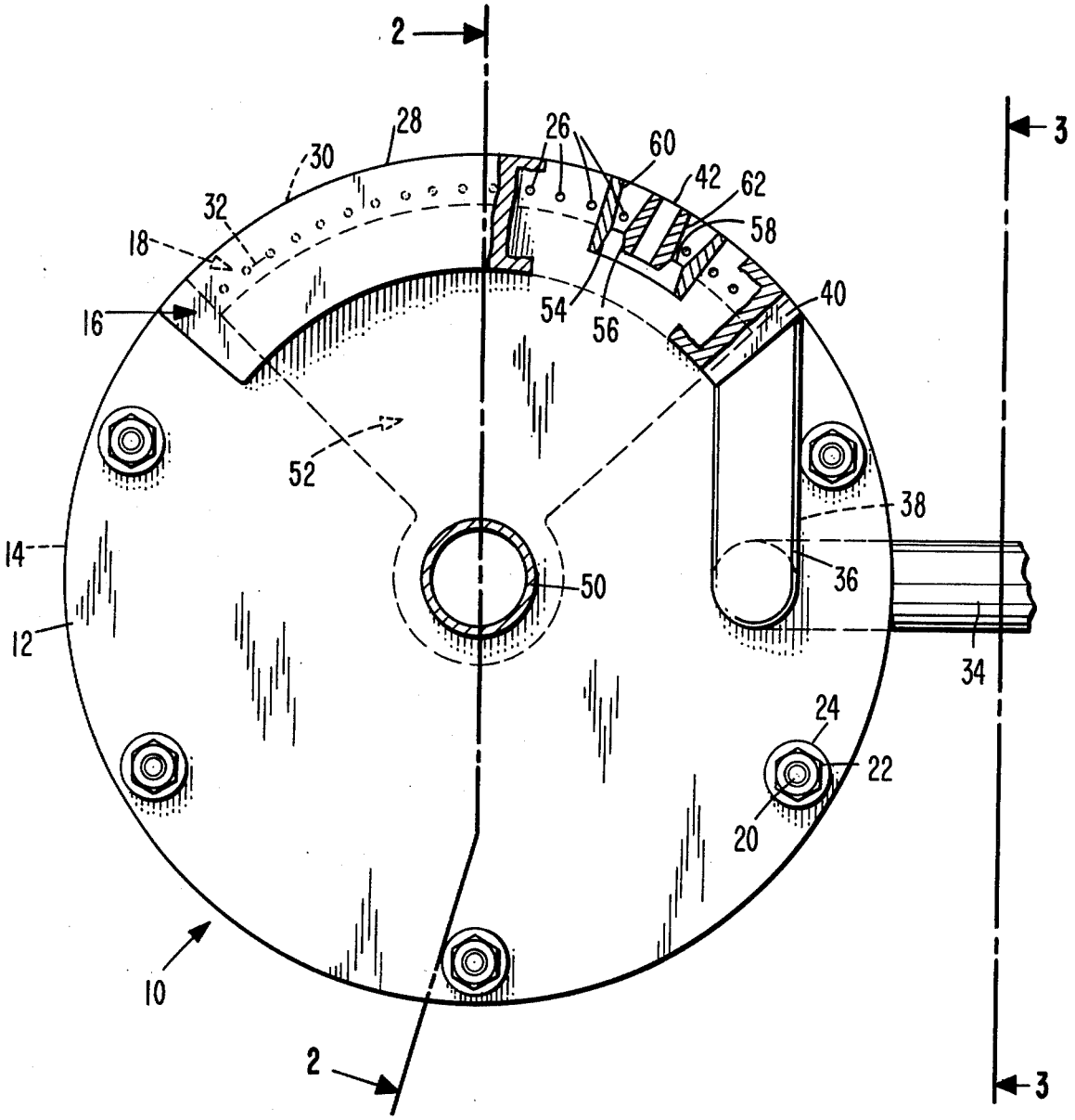
FIG. 1 is a schematic top plan view, having a generally V-shaped section removed, of a preferred embodiment of a snow-making nozzle in accordance with the present invention.

Turning now to FIG. 1, there may be seen generally at 10 a preferred embodiment of a snow-making nozzle assembly in accordance with the present invention. As may be seen in FIGS. 1-3, nozzle assembly 10 is comprised generally of a pair of upper and lower body plates, 12 and 14 respectively, with each plate having a water distribution header 16 and 18, respectively.

As may be seen most clearly in FIG. 1, body plates 12 and 14 are generally disc-shaped, are each approximately 5 inches in diameter, and are secured together in a stacked manner by any conventional means such as by threaded rods 20 held in place by nuts 22 and washers 24. While it is advantageous for at least a portion of the plates 12 and 14 to be disc-shaped to provide a spray that is fan-shaped, as will be discussed in detail hereinafter, it will be obvious that the body plates could have any desired shape, need not have flat exterior portions, could be held together by any suitable means such as welding or the like, and could be made from a number of materials other than metal which is preferred.

Each of the body plates 12 and 14 is provided with a grouping of water or liquid outlet ports 26 which, as may be seen in FIGS. 1 and 2 are spaced in opposition to each other in the upper and lower plates 12 and 14, are generally parallel to the axis of the plates, and are placed adjacent an outer peripheral portion 28 and 30 of body plates 12 and 14. These outlet ports 26 are positioned on an arc represented by dashed line 32 in FIG. 1. While the arc of outlet ports 26 is shown in FIG. 1 as extending through approximately 90°, it will be obvious that the arc could be increased or decreased as desired to provide a wider or narrower distribution spray when the nozzle is in operation. In the preferred embodiment, these water outlets are positioned approximately 0.25 inches from the peripheries 28 and 30 of plates 12 and 14, are each 0.0625 inches in diameter, and are spaced at 2° from each other with 41 ports on each plate. It is most important that each outlet 26 in the upper plate 12 be lined up with a corresponding outlet 26 in the lower plate 14 and that they are the same size. This can be accomplished in manufacture by forming plates 12 and 14 from a single thick plate and by drilling the outlet ports 26 before separating the plates. Spaced alignment pins (not shown) or other suitable alignment guides may also be provided tc insure that, should the plates be taken apart and reassembled, the outlet ports 26 in both of the plates 12 and 14 will be directly aligned with each other.

The pair of water distribution headers 16 and 18 may be seen in FIG. 1 as being generally arcuate and positioned on plates 12 and 14 to overlie the water outlet ports 26. A water inlet pipe 34 brings the water or other liquid to be atomized into inlet passages 36 and 38 of each header 16 and 18. While not shown in the several figures, it will be understood that inlet pipe 34 passes through body plates 12 and 14 to bring liquid to header 16 as well as 18. The headers terminate in arcuate distribution chambers 40 and 42 which, as discussed above, overlie the water outlet ports 26 in the upper and lower body plates 12 and 14. While no specific means for securing the distribution headers to the body plates is shown, it will be understood that any known means such as welding, the provision of mounting flanges or the like, or other means could be utilized. Alternatively, the headers can be formed as an integral portion of the body plates. It will further be understood that the particular shape or size of the headers is not crucial so long as the headers are of a suitable size and shape to allow unrestricted fluid flow to all of the water outlet ports and to insure that the liquid pressure throughout the headers is equal so that the flow through all the water outlets 26 will be equal.

A compressed air line 60 is, as may be seen in FIG. 2, secured in upper plate 12 and communicates with a generally flat, fan-shaped convergent-divergent nozzle generally at 52, which is formed as an interior portion of plates 12 and 14. As may again be seen in FIG. 2, nozzle 52 is comprised of converging wall sections 54 and 56 in plates 12 and 14 which extend radially outwardly from the inlet portion of the nozzle at the center of the plates to an arcuate venturi 58 which is located radially inwardly from the arc of water outlets 26. The nozzle then terminates in diverging wall secitons 60 and 62 which extend radially outwardly in plates 12 and 14 from venturi 58 to an outlet at the peripheries 28 and 30 of plates 12 and 14. In the preferred embodiment, the slopes of the converging and diverging wall portions are 5° from horizontal and the minimum space at venturi 48 is approximately 0.030 inches. As may be seen in FIG. 1, the fan shape of nozzle 52 is such that the nozzle has a slightly larger arc than the arc 32 of the water outlet ports. Although the compressed air inlet pipe 50 is shown as entering through the top plate 12, this inlet could as easily be through the bottom plate if desired. It has been found advantageous to position the air and water lines in opposition to each other to prevent undue stresses on the apparatus during its operation.

In operation, the air line 50 and the water line 34 are connected to suitable sources of compressed air and water under pressure such as are conventionally used in snow-making operations. Air at a pressure of 60-150 PSI is supplied to the air line and water at approximately the same pressure is fed through the water line.

The water, at a preferred flow rate of 20–30 GPM, passes into the distribution chambers 40 and 42 and thence through outlet ports 26 is opposed streams which impinge on each other midway between the diverging wall sections 60 and 62 of the nozzle 52. Concurrently, the compressed air, which enters nozzle 62 through line 50 at a rate of 50–300 CFM, moves through the converging section of the nozzle where its velocity increases. The compressed air contacts the atomized water which has passed through the outlet ports 26 in streams and has atomized when the streams collide. The air further atomizes the water and carries it out into the ambient air as a flat, fan-shaped spray of droplets which can then freeze to form snow. In the preferred emobidment, as was discussed above, the compressed air is supplied at a pressure of 60–150 PSI and at 50–300 CFM. The water is supplied at a pressure approximately equal to that of the air and at a flow of 5–100 GPM with 20–30 GPM being preferred. If desired, a flow control device can be placed in the water inlet line and can be sized to allow accurate adjustment of the water flow to prevent flooding of the nozzle. Since the water pressure and flow rate will vary substantially with elevation of the snow-making stations above the base pump, a range of different nozzles with several sizes of outlet ports can be used to facilitate good snow production at various altitudes. Different nozzles can also be used depending on the ambient temperature since more water flow can be utilized as the temperature becomes colder. Each nozzle is effective over a range of flow rates and temperatures but the availability of several different sizes of nozzles adds additional flexibility.

As was discussed previously, the snow-making nozzle in accordance with the present invention combines the best features of both internal and external atomizing nozzles and produces a uniform spray of atomized droplets in the range of 20–200 microns mass median diameter in an efficient manner utilizing air pressures readily available and at air flow rates substantially less than those required by currently available systems. The ability of the nozzle in accordance with the present invention to produce these uniform sprays of particles is because the water streams from the opposed water outlet ports strike each other and are broken down into small droplets out of contact with the nozzle's walls. These droplets are picked up, further atomized, and carried away from the nozzle substantially without contacting the nozzle walls. Accordingly there is less energy required than in other nozzles where the droplets must be carried off a wall surface or the like and there is more uniformity in droplet size since there is no surface for the droplets to gather and combine on. The venturi aspect of the nozzle reduces the air requirement by causing an increase in flow at the venturi and a further increase in the diverging section where the water droplets are contacted and carried away. The expansion of the gas through the nozzle also results in a heat transfer from the droplets to the air and aids in the freezing of the droplets.

Thus it will be seen that there has hereinabove been fully and completely disclosed a preferred embodiment of a snow-making nozzle assembly in accordance with the present invention which provides a nozzle which operates in an unexpectedly superior fashion over prior generally similar atomizing nozzles, and which is superior to other snow-making nozzles in its ability to produce good snow in quantity through a range of temperatures and at a power requirement of compressed air volume considerably less than prior snow-making assemblies. The present nozzle assembly is also rugged, durable, requires little maintenance, and has no moving parts to wear out. It will be obvious to one of ordinary skill in the art that a number of changes in, for example, the materials used in the nozzle, the shape of the body plates, the arc of the fan, the shape of the water headers and the like could be made without departing from the true spirit and scope of the invention and hence the invention is to be limited only by the following claims.

We claim:

1. A snow-making nozzle assembly for use in atomizing water and projecting the atomized water by compressed air into atmosphere having an ambient temperature below about 32° F. to form snow, said nozzle assembly comprising:

upper and lower body plates, each said plate having a grouping of plural spaced water outlet ports passing through a peripheral portion of each said plate with each said port in said upper plate positioned substantially directly above and in opposition to a corresponding one of said ports in said lower plate, said corresponding ones of said ports in said upper and lower plates having corresponding axes which are substantially perpendicular to said plates;

upper and lower water distribution headers carried by said upper and lower plates, said headers terminating in distribution chambers overlying corresponding groupings of water ports for supplying water under pressure to said water ports;

a converging-diverging nozzle in said plates, said nozzles extending outwardly from an inlet at an interior portion of said plates to an outlet at said peripheral portion of said plates, said outlet portion of said nozzle providing a space between said groups of ports in said upper and lower plates, said groups of ports being positioned in said plates at the diverging portion of said converging-diverging nozzle;

means for supplying water under pressure to said upper header and said lower header for passage through said ports in separate streams each of which impinges on a corresponding stream from an opposed port for atomization midway in said space between said plates whereby said air under pressure in passing out through said nozzle contacts said atomized water to atomize it further and to carry said atomized water into the atmosphere for formation of snow.

2. The apparatus of claim 1 further wherein said converging-diverging nozzle is generally fan-shaped with said outlet being wider than said inlet.

3. The assembly of claim 2 further wherein said peripheral portions of said plates are curved and said grouping of water ports are correspondingly curved.

4. The assembly of claim 3 further wherein a venturi portion of said converging-diverging nozzle is positioned between said inlet of said nozzle and said curved groupings of water ports.

5. The assembly of claim 4 further wherein said air under pressure is supplied to said nozzle at a pressure of between about 60–150 PSI.

6. The assembly of claim 5 further wherein the pressure of the water supplied to said headers is approximately the same as the pressure of the air supplied to the nozzle.

7. The assembly of claim 6 further wherein said air under pressure has a flow rate of between about 50–300

CFM and said water has a flow rate of between about 5–100 GPM.

8. The assembly of claim 7 further wherein each of said water outlet ports is about 0.0625 inches in diameter.

9. The assembly of claim 8 further wherein said venturi has a space of about 0.030 inches.

10. The assembly of claim 9 further wherein each said grouping of outlet ports includes 41 outlets spaced at about 2° from each other.

* * * * *